United States Patent [19]

Peterson

[11] 3,979,558

[45] Sept. 7, 1976

[54] SIGNALING SYSTEM

[75] Inventor: Eugene Peterson, New York, N.Y.

[73] Assignee: Bell Telephone Laboratories, Incorporated, Murray Hill, N.J.

[22] Filed: June 30, 1944

[21] Appl. No.: 542,922

[52] U.S. Cl. ..... 179/1.5 R; 179/1.55

[51] Int. Cl.[2] ..... H04K 1/04

[58] Field of Search ..... 179/1.5, 15, 1.5 R; 178/71, 71 B, 71 E

[56] References Cited

UNITED STATES PATENTS

| | | | |
|---|---|---|---|
| 1,752,485 | 4/1930 | Hartley | 179/1.5 |
| 2,132,205 | 10/1938 | Dickieson | 179/1.5 |
| 2,151,091 | 3/1939 | Dudley | 179/1.5 |
| 2,411,683 | 11/1946 | Guanella | 179/1.5 R |

*Primary Examiner*—H.A. Birmiel
*Attorney, Agent, or Firm*—H. A. Burgess

EXEMPLARY CLAIM

1. In a speech privacy transmission system, means for analyzing speech currents into component frequency band currents in a plurality of separate circuits, a corresponding plurality of separate transmission channels, a common keying circuit having an input side and an output side for keying each of said frequency band currents in succession, distributor means for connecting the input side of said keying circuit to each of said plurality of separate circuits in rotation to enable the frequency band currents therein to be keyed in succession, and distributor means for connecting the output side of said keying circuit to each of said plurality of transmission circuits in rotation to enable the keyed currents to be individually transmitted over said respective channels.

12 Claims, 3 Drawing Figures

Figure 1:
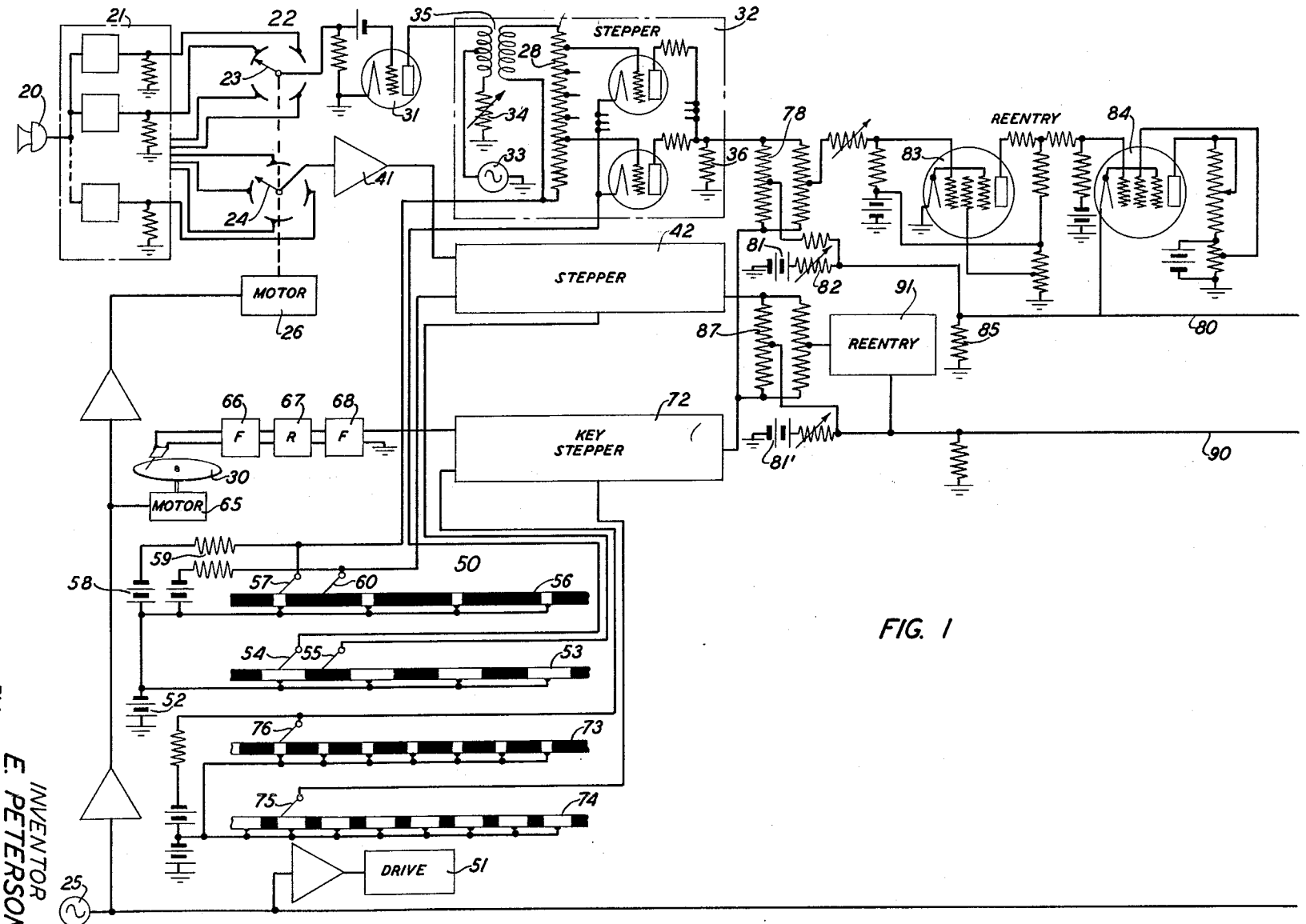

INVENTOR
E. PETERSON
BY
H. A. Burgess
ATTORNEY

INVENTOR
E. PETERSON
BY H. A. Burgess

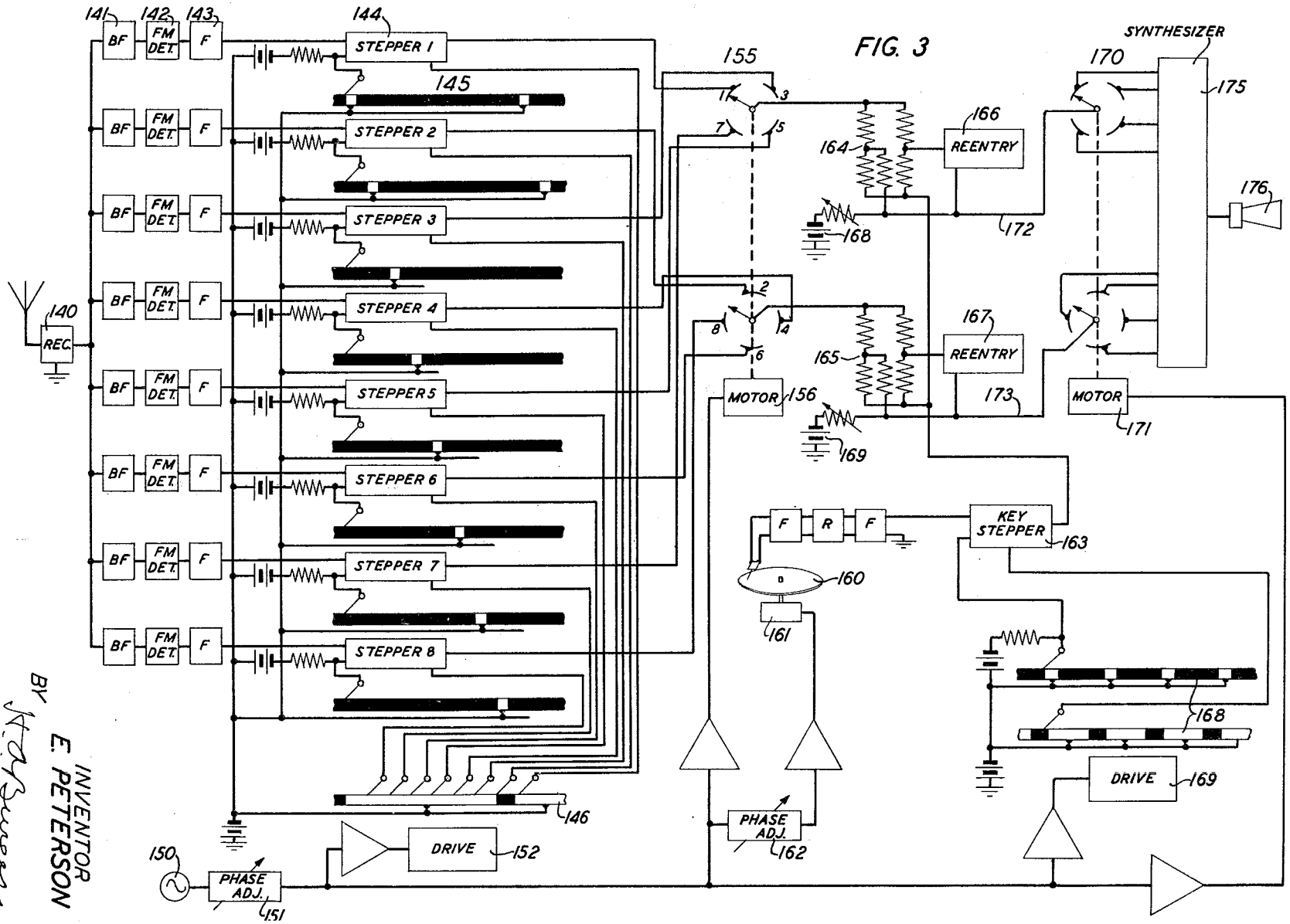
INVENTOR
E. PETERSON
BY H. A. Burgess
ATTORNEY

SIGNALING SYSTEM

The present invention relates to the secret transmission and reception of speech or similar types of signaling waves and more particularly it relates to the type of system in which the speech or other signal is first analyzed to derive a plurality of low frequency index currents in separate circuits which can be separately coded and transmitted to a distant receiving point where the speech or signal is reconstructed under control of these transmitted currents after they have been decoded.

Objects of the present invention are to reduce the amount of equipment needed in such a system, to economize on frequency band width required and to relax the requirements as to synchronism between terminals without sacrifice in attainable secrecy.

It has been proposed to provide transmission channels on a multiplex carrier basis between the communicating stations, with the number of such channels equal to the number of low frequency speech-defining currents into which the speech is analyzed and to provide individual coding equipment for the various transmission channels. This results in a large amount of equipment, much of which is not used to full capacity especially where the speech-defining currents are transmitted in stepped pulses with each step value held constant between stepping times.

It has further been proposed to provide a single coding equipment which is shared on a time basis by all of the separate circuits in which the speech-defining currents exist, by being switched rapidly from one circuit to the next in rotation and to provide a single transmission channel between the communicating stations for transmission of the fragmented current in the output of the common coding equipment. While this type of system results in economy of certain types of terminal equipment, it imposes rather severe restrictions upon synchronism between the communicating stations and is more subject to interference arising from atmospheric conditions of the type that affect long distance radio transmission, because of the shortness of the pulses used. The shortness of the pulses also places restrictions upon the minimum band width that can be satisfactorily used.

Assuming a given degree of security against unauthorized reception of the transmitted information, it becomes important to have available different types of systems all having the given degree of security but adapted to different conditions of use, such as systems with different degrees of portability, systems for permanent location, or systems specially suited for long distance radio transmission or for short links or over lines, to cite a few typical examples. Depending upon the conditions and requirements of use, it may become important in one case to conserve weight or reduce the number of moving parts or relax synchronism requirements or conserve band width, etc., while in another case these matters may be secondary in importance to some other considerations.

The system of the present invention represents a great simplification in equipment over the first of the two known types of systems referred to above and offers material advantages over the second-mentioned type in requiring less exact synchronism between the communicating stations, economizing on band width and being less subject to certain types of interference.

In accordance with the present invention the speech-defining currents in the several analyzer paths are coded in succession by common coding equipment which is shared among the paths on a time basis, and the coded speech-defining pulses are then distributed over a plurality of transmission channels, one current pulse to a channel, for transmission to the distant station. A generally similar arrangement is followed out in reverse order at the receiver. Since each transmission channel serves to transmit only the coded pulses from one analyzer path, the transmitted pulses can be increased in length to correspond to the time between sampling instants of the analyzer currents in one path. This greatly decreases the synchronizing requirements between stations.

Figure 2:
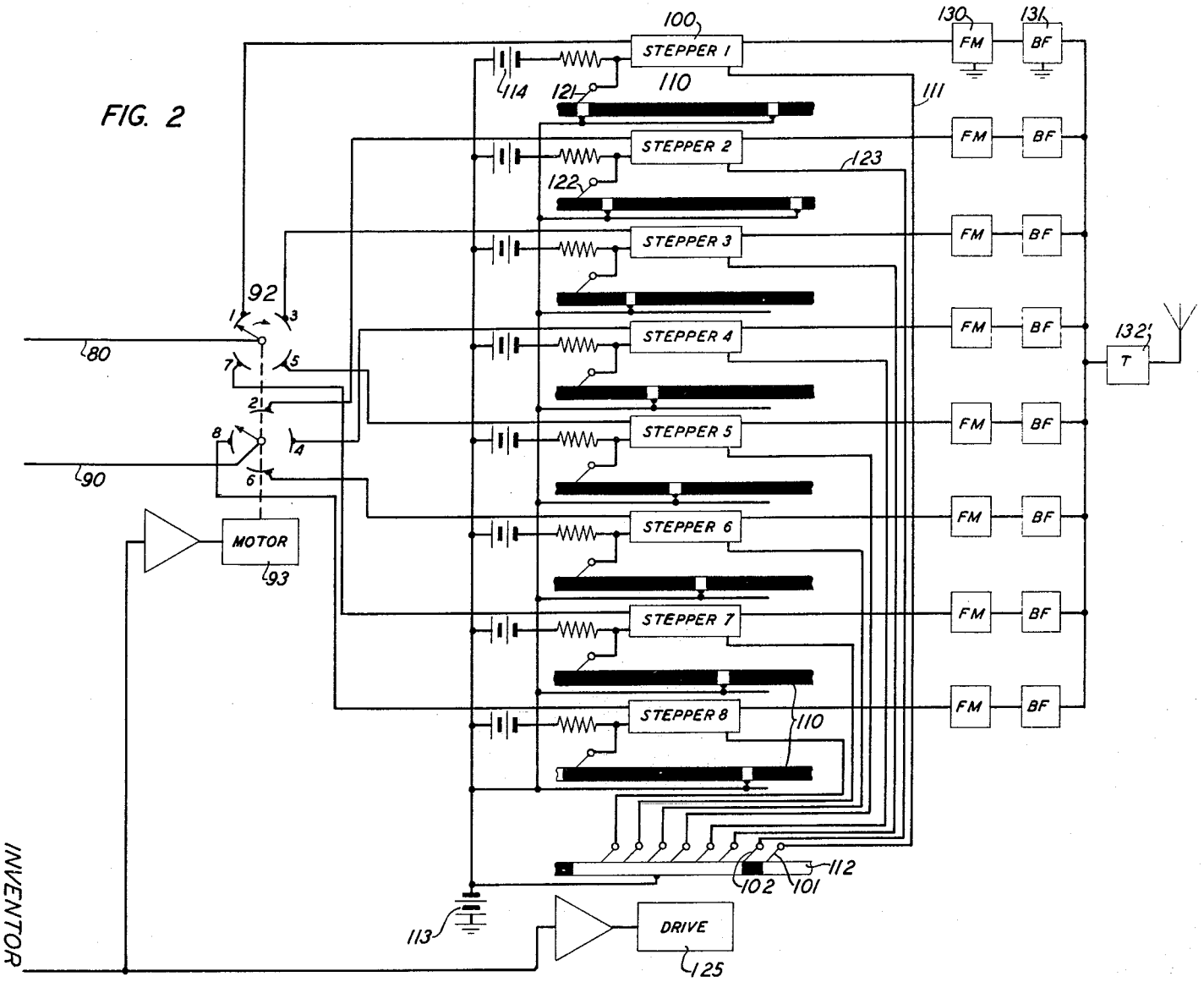

The nature of the invention and its objects and features will be more fully understood from the following detailed description of an illustrative embodiment shown in the accompanying drawings in which:

FIGS. 1 and 2 together with FIG. 2 at the right of FIG. 1 show in schematic diagram a transmitting terminal according to the invention; and FIG. 3 is a similar diagram showing the receiving terminal.

The present disclosure relates to the same type of transmission that is disclosed as taking place in Lundstrom-Schimpf application Ser. No. 456,322, filed Aug. 27, 1942, which issued on July 29, 1975 as U.S. Pat. 3,897,591, in that the speech or other signal waves are first analyzed in a vocoder analyzer to derive speech-defining currents in separate circuits which are individually enciphered by means of key waves, the resulting waves being sent on a multiplex carrier basis. At the receiver duplicate key waves are used to decipher the speech-defining currents which then control a speech vocoder synthesizer to reconstruct the original speech message. The analyzer and synthesizer in the present disclosure may be identical with those of Lundstrom-Schimpf, eight vocoder channels being assumed in the present disclosure by way of example. Many of the individual pieces of equipment such as the steppers and reentry circuits may be of the same type as disclosed in the Lundstrom-Schimpf application.

The distinction in the present disclosure over the Lundstrom-Schimpf system is in the use in common by a group of vocoder channels of certain of the enciphering and deciphering equipment, respectively, at the terminal stations whereby a great simplification in the amount of necessary equipment is realized without a corresponding sacrifice in secrecy of transmission. This common equipment is allotted to successive channels in turn on a time division basis. For this purpose rotary or other forms of distributors may be used.

Referring to FIG. 1, speech waves from microphone 20 or other input are sent through vocoder analyzer 21, shown as having eight channels, one of which may be used for pitch control and the others for spectrum control. The eight channels as they emerge from the analyzer are connected to segments of rotary distributor 22 shown as comprising two sets of four segments with two brushes traversing them. Each contact is made for one-eighth of a rotation. For illustrative purposes, it will be assumed herein that the brushes rotate at 42 revolutions per second, giving a contact time of approximately 3 milliseconds. Each channel current is sampled in this way every 24 milliseconds and the sampling time is about 3 milliseconds. These and other magnitudes used throughout the description are taken as reasonable values for use in practice but are subject to wide variation and are not to be considered as limiting. The various apparatus at one station is all timed from a source of standard frequency 25 which may be a crystal oscillator generating a wave of great constancy of frequency, the frequency being, for example, 42 cycles per second so as to drive synchronous motor 26 at 42 revolutions per second.

Brush 23 is connected to the grid of an amplifier tube 31 the output of which is connected through a transformer 35 to the grid circuits of the five stepper tubes of stepper 32. The plate voltage for the amplifier 31 consists of alternating current having a frequency by way of example of 2 kilocycles per second supplied from source 33 which is connected to the midpoint of the primary winding of the output coil. A balancing resistance 34 is used so that when there is no externally impressed voltage on the grid of the amplifier 31 no voltage exists in the secondary winding of transformer 35.

As in the case of the Lundstrom-Schimpf disclosure, the grids of the stepper tubes are biased highly negative towards their cathodes at all times except during the sampling period when they are biased to the right value to permit them to sample the instantaneous input voltage. The stepper tubes are gas-filled tubes so that they continue to transmit plate current after they have been broken down under control of the impressed grid potentials until the plate circuit voltage is interrupted. The grids are connected to graduated points on potential dividing resistance 28. Depending upon the signal voltage in the respective vocoder channels in the sampling interval one or more or none of the stepper tubes may be rendered conductive. This results in an output current through resistor 36 which varies in definite steps depending upon the amplitude of the signal current at the time of sampling. These steps may be designated for convenience as 0, 1, 2, 3, 4 and 5. The current fed into the resistance 36 from the stepper will be 0 if the signal current at the time of sampling has a value between 0 and step 1 value (no tube fires). The output current from the stepper will have a value of step 1 if the signal current sampled has a value greater than step 1 but less than step 2, (one tube fires), etc.

Brush arm 24 similarly connects through an amplifier 41 to stepper 42. Due to the staggered arrangement of the distributor segments, steppers 32 and 42 operate in alternation. This arrangement permits the use of a single key for keying both groups of vocoder channels as will presently be described.

The necessary voltages for timing the operation of the steppers 32 and 42 may be obtained from vacuum tube circuits as in the Lundstrom-Schimpf application but for simplicity of illustration in the present instance these voltages are shown as being derived from a mechanical rotating commutator generally indicated at 50 driven at constant rate from standard source 25 by means of a synchronous motor 51. Plate voltage is supplied to the steppers in the form of a negative voltage applied to the cathode from 150-volt battery 52, the plates of the stepper tubes being connected to ground through output resistors. Battery 52 is applied to all of the conducting segments of commutator ring 53, this and the other commutator rings being shown in developed form. These conducting segments have such length that a potential of −150 volts is applied to the stepper tube cathodes for 3 milliseconds and is interrupted for 3 milliseconds. This voltage is applied over brush 54 to the cathodes of stepper 32 and over brush 55 to the cathodes of stepper 42.

Commutator ring 56 governs the application of bias voltages to the stepper tube grids. When brush 57 is on an insulating segment the full voltage of battery 58 is applied to the grids of the stepper tubes through resistance 59. All of the conducting segments of ring 56 are connected in common to the negative pole of battery 52 so that normally the stepper tube grids are held at −150 volts with respect to their cathodes. When brush 57 passes over a conducting segment the grids of the stepper tubes are biased to 0 volts relative to their cathodes (or, if desired, to some other suitable voltage by insertion of a bias battery in the lead between brush 57 and the grids), since brush 57 connects the grid circuit branch directly to the cathode via brush 54.

It will be seen from the position of the commutator elements that whenever brush arm 23 begins to make contact with one of the distributor segments, brush 57 applies a suitable voltage to the stepper tube grids to enable them to sample the vocoder signal current and negative voltage to ground is applied over brush 54 to the stepper tube cathodes so as to permit them to be broken down under control of the sampled current. The length of the conducting segments in commutator ring 56 is illustrated as being quite short, for example, 1 or 2 milliseconds, although it could, if desired, be equal to the time of contact between brush 23 and a distributor segment. Brush 57 begins to traverse a conducting segment every quarter of revolution of the distributor 22, that is, about every 6 milliseconds. The length of the conducting period of the stepper tubes, once they have been broken down, is determined by the length of the conductive segments in commutator ring 53 and as stated this may be about 3 milliseconds. The grid bias for the tubes of stepper 42 is controlled from brush 60.

Key waves for enciphering the pulses in the outputs of steppers 32 and 42 are obtained from record 30 which is driven at constant speed from motor 65 under control of standard source 25. The key may be prepared in the manner disclosed in the copending application of H. W. Dudley, Ser. No. 542,946, filed June 30, 1944, which issued on Sept. 30, 1969 as U.S. Pat. 3,470,323, and consists of a suitable alternating current modulated by pulses of about 3 milliseconds duration varying in amplitude in random manner. This modulated current is selected by filter 66 and rectified at 67 to derive direct current pulses which are passed through low-pass filter 68 to key stepper 72. This may be a duplicate of steppers 32 and 42 and is similarly controlled from commutator rings 73 and 74. The negative cathode voltage is applied from brush 75 for approximately 3 milliseconds and is interrupted for a short period just sufficient to insure deionization of the stepper tubes. The grid bias is controlled from brush 76 in such a manner as to hold the grid bias at −150 volts relative to the cathodes for most of 3-milliseconds interval but to change the grid bias to 0 or some low voltage value suitable for sampling the key pulses in the output of filter 68 once every 3 milliseconds.

As a result of the action of the steppers 32, 42 and 72 output currents are produced as follows. Stepper 32 produces pulses of about 3 milliseconds duration separated by 3-millisecond spacings. Stepper 42 produces pulses similar in form but staggered with respect to the pulses in the output of stepper 32. Stepper 72 produces 3-millisecond pulses except for slight interruption periods between them and alternate ones of these pulses coincide in time with the pulses in the output of stepper 32 while the intervening pulses coincide in time with the output of stepper 42. Each output pulse from stepper 32 is, therefore, supplied with a key pulse and similarly each output pulse from stepper 42 is supplied with a different key pulse.

The sampled pulses from stepper 32 are added to the corresponding key pulses by means of resistance bridge 78 and if no reentry is to take place, the summation pulses are applied to common output conductor 80. It will be noted, however, that an inversion takes place due to the presence of positive battery 81 and resistance 82. The signal and key pulses appearing at the middle of bridge 78 have negative polarity with respect to ground and, therefore, subtract from the positive voltage supplied from battery 81, thus producing positive pulses in conductor 80 with their amplitudes inverted with respect to the summation pulses in bridge 78.

If the summation signal plus key voltage exceeds step 5, reentry occurs subtracting six steps from the summation value. The reentry circuit is shown as comprising pentode tubes 83 and 84 and may be identical in operation to the reentry circuits disclosed by Lundstrom-Schimpf. Tube 83 has a positive grid bias applied to it and for all applied summation pulses of less than step 5 value tube 83 transmits saturation current and tube 84 is cut off. A negative summation pulse exceeding step 5 value throws the control grid of tube 83 so far negative as to interrupt space current through this tube, thus causing tube 84 to transmit saturation current through resistor 85, this current being of such value as always to subtract six steps from the summation current pulse.

The output pulses from stepper 42 combine with key pulses from stepper 72 in output bridge 87 and the summation pulses are inverted and applied to conductor 90. Reentry 91 operates as described above to subtract six steps from the summation pulses whenever the summation pulse exceeds step 5 in value. The two conductors 80 and 90, therefore, have applied to them positive pulses of about 3 milliseconds duration and constant value relative to ground from battery 81 or 81' alternating with current intervals of about 3 milliseconds duration in which the current may have any one of six values in steps from said positive value to and including 0, these intermediate current magnitudes appearing in random manner and giving no clue to the signal.

Conductors 80 and 90 lead to brush arms of a pair of distributors 92 (FIG. 2) which may be entirely similar to distributors 22, driven from synchronous motor 93 under control of current from standard source 25. The eight segments of distributor 92 are connected individually to eight steppers shown at 100 so controlled as to produce output current pulses, each having a duration approximately equal to one entire revolution of the distributor brush or about 24 milliseconds. A sufficient time must be allowed between these pulses to permit deionization of the stepper tubes and inaccuracies in the distributor timing. Allowing 2 milliseconds for these to take place, the output pulses may be considered as having a duration of about 22 milliseconds. Obviously, distributors 22 and 92 could be driven from one shaft by one motor.

The beginning of each stepper pulse is determined by the time of contact of the grid bias brush 121 with the conducting segment of the corresponding ring of timing commutator generally indicated at 110 and consisting of nine separate rings (shown for convenience of illustration as spread out and located adjacent the respective steppers). When brush 121 serving stepper No. 1 makes contact with a conductive segment of its distributor ring the upper brush arm of distributor 92 is in contact with segment No. 1 and the pulse existing in conductor 80 at that time is sampled, resulting in the firing of the appropriate number of tubes of stepper No. 1, this stepper being identical with stepper 32. Negative cathode voltage is applied at this time to all of the tubes of stepper No. 1 over conductor 111 from brush 101 which is shown in contact with the conducting segment of commutator ring 112. A voltage of −150 volts is applied to all conducting segments of this ring from battery 113. As soon as brush 121 passes off a conducting segment and onto an insulating segment the grids of all tubes of stepper No. 1 are thrown negatively to −150 volts with respect to their cathodes by battery 114 and are maintained at this voltage until the next sampling time. As stated, brush 121 determines the beginning of the stepper impulse. The end of the stepper impulse is determined by brush 101 passing off one of the conducting segments of commutator ring 112 onto an insulating segment, thus interrupting the space current supply voltage to all of the tubes of stepper 100.

It will be seen from the foregoing description that stepper 100 converts the short pulse received from distributor 92 having a duration of about 3 milliseconds into a much longer pulse, about 20 or 22 milliseconds duration, for transmission purposes. In the same way each of the other seven steppers converts the short received pulse into a long pulse for transmission. As soon as the brush of upper distributor 92 passes off segment No. 1 the lower brush begins to make contact with segment No. 2. The pulse received over conductor 90 is, therefore, applied to the grids of stepper No. 2 and at this same time brush 122 has arrived at a conducting segment of its distributor ring and is conditioning the grids of the tubes of stepper No. 2 to sample the pulse received from conductor 90. Negative cathode voltage is supplied to the tubes of stepper No. 2 at this time over conductor 123 from brush 102. Stepper No. 2, therefore, transmits a pulse of the same duration as the pulse from stepper No. 1 but the beginning and end of the pulse are displaced in time slightly from that in the output of stepper No. 1. This same action follows throughout all of the eight steppers. After the brush of distributor 92 has passed off segment No. 8 contact is again made with segment No. 1 and the same cycle is gone through again for the next eight keyed pulses received over conductors 80 and 90 in alternation with each other. The distributor 110 is kept in proper step with distributor 92 by obtaining the driving voltage for the synchronous motor 125 from standard source 25.

Each of the eight steppers shown at 100 feeds into a respective frequency modulated oscillator 130 and the transmission from this point onward may be identically the same as in the case of the Lundstrom-Schimpf disclosure. Each oscillator has a different normal frequency so that the eight channels can be separated on a frequency selective basis. Band filters 131 select one sideband of the modulated waves for transmission. The eight sidebands are transmitted to the distant station over any suitable medium or path, such as by means of radio transmitter 132, although a line or carrier channel can be used, if desired.

Referring to FIG. 3, the waves are received at 140 and the eight channels are separated from one another by means of the band filters 141 each of which is followed by a frequency modulation detector circuit 142 for recovering the pulses. These pulses of about 20 to 22 milliseconds duration are transmitted through low-pass filters 143 and impressed upon a series of steppers 144 which may be identical to those shown at 100 and are similarly controlled from a timing commutator 145 having eight rings for controlling grid bias applied to the steppers and one ring 146 with eight brushes for supplying negative cathode voltage.

A standard source 150 provides the timing of the apparatus at the receiving station, FIG. 3. This source is of the same type as source 25. A phase adjuster 151 is shown for facilitating synchronous operation of the two stations. This phase adjuster provides one means for compensating for transmission delay between the stations. The commutator 145 is driven by motor 152 under control of source 150.

On account of the increase made in the length of the pulses before transmission from about 3 milliseconds to 20 or more milliseconds the problem of synchronizing the two stations is made much easier. For example, the steppers 144 may be set normally to sample the received pulses at about the center of each pulse. Deviations in phase position either side of the center for several milliseconds will make no difference in the received signals since the pulses are flat over the greater part of their duration.

Each stepper output is connected to one of the segments of distributor 155 which may be entirely similar to distributor 92 and is driven from motor 156 under control of oscillator 150. As noted above, the timing of the steppers 144 is delayed with respect to the steppers 100 not only to allow for transmission path delay but to sample each received pulse at about the middle of the pulse. The brushes of distributors 155 are still further retarded in order to sample the middle part of the stepper output pulses, the retardation in these brushes being assumed to be one full rotation. In some cases the steppers 144 may be omitted and the outputs of filters 143 may be directly connected to segments of distributor 155. The distributor brushes would in that case be retarded one-half rotation.

The key for deciphering the message pulses is derived from phonograph record 160 which is a duplicate of record 30 and is driven in proper synchronous relation with respect to record 30 by motor 161. A phase adjuster is shown at 162 to facilitate bringing the records into proper phase relation with each other. Key stepper 163 may be identical with key stepper 72 and its grid and cathode voltages are timed from commutator 168 driven by motor 169 under control of oscillator 150. The key is added to the outputs of distributor 155 by resistance bridges 164 and 165. The reentry circuits 166 and 167 may be identical with those shown in FIG. 1. The battery 168 or 169 reinverts the signal pulses which feed into the brush arms of distributor 170, driven from motor 171 under control of oscillator 150. Distributor 170 distributes the deciphered, normal pulses in the output leads 172 and 173 over the eight channels leading into the synthesizer 175. This synthesizer may be identical with that disclosed in Lundstrom-Schimpf and operates in the same manner to reconstruct the original speech message in an output telephone line or receiver 176.

What is claimed is:

1. In a speech privacy transmission system, means for analyzing speech currents into component frequency band currents in a plurality of separate circuits, a corresponding plurality of separate transmission channels, a common keying circuit having an input side and an output side for keying each of said frequency band currents in succession, distributor means for connecting the input side of said keying circuit to each of said plurality of separate circuits in rotation to enable the frequency band currents therein to be keyed in succession, and distributor means for connecting the output side of said keying circuit to each of said plurality of transmission circuits in rotation to enable the keyed currents to be individually transmitted over said respective channels.

2. In a speech privacy transmission system, means for analyzing speech currents into component frequency band currents in a plurality of separate circuits, a corresponding plurality of separate transmission channels, a common keying circuit having an input side and an output side for keying each of said frequency band currents in succession, distributor means for connecting the input side of said keying circuit to each of said plurality of separate circuits in rotation to enable the frequency band currents therein to be keyed in succession, distributor means for connecting the output side of said keying circuit to each of said plurality of transmission circuits in rotation to enable the keyed currents to be individually transmitted over said respective channels, and a holding circuit in each of said transmission circuits to prolong the keyed currents in said transmission circuits.

3. The system claimed in claim 2 in which said holding circuit in each of said channels comprises a stepper for maintaining the current in each transmission channel at substantially constant value during the time the keying circuit is connected to the others of said channels.

4. In signal transmission, means to sample each of a plurality of different signal currents in succession, a common means for altering the character of the sampled currents to provide secrecy of transmission, a transmitting medium, means to superpose multiplex channels on said medium operating in different frequency bands, and distributor means for sending each sampled current after its character has been altered by said common means into a different one of said multiplex channels for transmission over said medium.

5. The combination according to claim 4 including in each of said multiplex channels a holding circuit for maintaining the current in the respective channel at constant value beyond the sampling time and for a time during which others of said signal currents are being sampled.

6. In signaling, a plurality of incoming channels carrying signal currents to be transmitted, a transmission medium, means to provide a corresponding plurality of separate transmission channels on said medium using different frequency bands for simultaneous transmission, a signal enciphering means having an input and an output, distributor means for operatively connecting said incoming channels one at a time in succession to the input of said enciphering means, and distributor means for operatively connecting the output of said enciphering means to one after another of said transmission channels in succession.

7. The combination according to claim 6 in which each of said transmission channels includes a means for maintaining the enciphered signal on said transmission channel for a time beyond the period of connection of said enciphering means to the respective transmission channel and during a time in which said enciphering means is connected to others of said transmission channels.

8. In signaling, a plurality of incoming channels using different frequency bands for simultaneous transmission, each channel carrying signals to be deciphered, a common deciphering means having an input and an output, a corresponding plurality of separate signal receiving channels, distributor means for operatively connecting said incoming channels one at a time in succession to the input of said deciphering means and distributor means for operatively connecting the output of said deciphering means to one after another of said signal receiving channels in succession.

9. In secret telephony, means to analyze speech message waves to derive therefrom a plurality of low frequency speech-defining currents in separate circuits, means to sample each of said currents in succession, means associated with said sampling means to encipher each sampled current in accordance with a different key current, a plurality of separate transmission channels equal in number to said separate circuits, for transmitting the enciphered currents, and means to impress on said transmission channels in succession different enciphered currents derived from different ones of said respective circuits.

10. The combination recited in claim 9 in which each of said transmission channels includes a stepper, means to establish an output current in the stepper under control of the impressed current, and timing means for maintaining said output current at substantially constant value during the time others of said currents in others of said separate circuits are being sampled.

11. In multiplex transmission, a plurality of originating signal circuits, a corresponding number of high frequency carrier transmission channels superposed on a common path or medium, said channels using respective frequency bands, means to transmit over each channel relatively long pulses of current with intervening relative short spaces, means to time the pulses to displace them in time in respective channels, said pulses in each channel overlapping in time the pulses in others of said channels, means to sample the signal current in each of said circuits in succession, and means to initiate said pulses in respective channels in response to the sampled signal currents in respective circuits.

12. The combination recited in claim 11 in which said sampling means has associated with it an enciphering means common to said circuits for combining with each sampled current a different key current.

* * * * *